US005454736A

United States Patent [19]

Chou

[11] Patent Number: 5,454,736

[45] Date of Patent: Oct. 3, 1995

[54] MINI UHF COAXIAL CABLE CONNECTOR

[75] Inventor: Long S. Chou, Taipei, Taiwan, Prov. of China

[73] Assignee: Entropy International Co., Ltd., Taiwan, Prov. of China

[21] Appl. No.: 247,689

[22] Filed: May 23, 1994

[51] Int. Cl.[6] ..... H01R 9/07

[52] U.S. Cl. ..... 439/578; 439/733.1

[58] Field of Search ..... 439/578–585, 439/675, 668, 669, 733, 734, 738, 744, 746, 747, 748, 750, 752, 933.1

[56] References Cited

U.S. PATENT DOCUMENTS 3,539,976 11/1970 Reynolds ..... 439/585
3,980,385 9/1976 Hirokawa et al. ..... 439/733
4,374,604 2/1983 Hemmer et al. ..... 434/595
4,859,197 8/1989 Toramoto et al. ..... 439/675
4,995,836 2/1991 Toramoto ..... 439/578

*Primary Examiner*—David L. Pirlot
*Attorney, Agent, or Firm*—Bacon & Thomas

[57] ABSTRACT

A mini UHF coaxial cable connector includes a die cast housing, a dielectric received inside the die cast housing, a terminal disposed inside the dielectric, a coaxial cable extending to the die cast housing via the terminal, and a ferrule tightly fitted around the coaxial cable to connect the cable to the die east housing. The dielectric has two radially and inwardly projecting and axially extending elongated ribs formed on an inner wall thereof, and the terminal has two axially extending elongated slots formed thereon which correspond to and receive the two elongated ribs of the dielectric, such that the terminal will not rotate relative to the dielectric and twisting and breakage of the coaxial cable as the antenna is screwed into the connector can be avoided.

2 Claims, 5 Drawing Sheets

MINI UHF COAXIAL CABLE CONNECTOR

BACKGROUND OF THE INVENTION

1. Field of the Invention

The present invention relates to a mini ultra-high-frequency (UHF) coaxial cable connector, and more particularly to a connector used as an antenna base connection which is screwed onto to a receiving end of the antenna in order to firmly connect the antenna with various types of base units without the risk of damaging the antenna.

2. Description of the Prior Art

FIGS. 1 and 2 illustrate a conventional antenna base connection in which a die cast housing 11 has a dielectric 12 and a terminal 13 installed therein, such that the terminal 13 connects a base unit to a coaxial cable 21 connected to an antenna. In such a structure, when the antenna is screwed onto the the antenna base connection of the unit, wire rods of the unit corresponding to the antenna base connection clamp the center conductor inside the antenna at a point "A" near a central portion of the terminal 13, as indicated in FIG. 2. When the die cast housing 11 is connected with an antenna, a point "C" on the center conductor of the coaxial cable 21 is twisted because point "B" on the same cable 21 is firmly clamped by the housing 11. Such twisting of the center conductor cause the conductor to break, and this is a major factor in the antenna base connection failures. The failed antenna base connection failures must be replaced and therefore causes inconvenience to users.

In view of the above-mentioned drawbacks of the conventional antenna base connection of various wireless and/or wire-connected phones, the inventor has developed the present invention to provide an improved coaxial cable connector for connecting an antenna to a base unit.

SUMMARY OF THE INVENTION

A primary object of the present invention is, therefore, to provide a mini UHF coaxial cable connector which will not cause the center conductor inside the cable to break due to twisting when the cable is connected to the connector by screwing, and thereby extends the usable life of the antenna base connection without the need for frequent replacement of the same by the user. The present invention is therefore economical and convenient to use.

Another object of the present invention is to provide a mini UHF coaxial cable connector in which an embossed area is formed on the terminal to provide better electrical contact of the antenna with the connector.

To achieve the above and other objects, a mini UHF coaxial cable connector according to the present invention comprises a die cast housing, a dielectric and a terminal inside the housing, and a ferrule. The dielectric is tightly fitted inside the die cast housing. The terminal is disposed inside the dielectric to connect one connecting end of a coaxial cable, and is formed with two elongated slots that each just receive a rib radially and inwardly projecting from an inner wall of the dielectric, such that the terminal is fixedly received inside the dielectric without the possibility of being rotated when the antenna is screwed into the connector. The ferrule wraps and fixes the connecting end of the coaxial cable to an outer end of the die casting housing. With the mini UHF coaxial cable connector of the present invention, the connecting end of the antenna will not be twisted when the same is connected to the connector and, therefore, breakage of the center conductor inside the cable of the antenna due to twisting can be advantageously prevented. Since an embossed area is provided on the terminal, a better electrical contact of the terminal with the antenna is also achieved.

DETAILED DESCRIPTION OF THE PREFERRED EMBODIMENT

Figure 5:
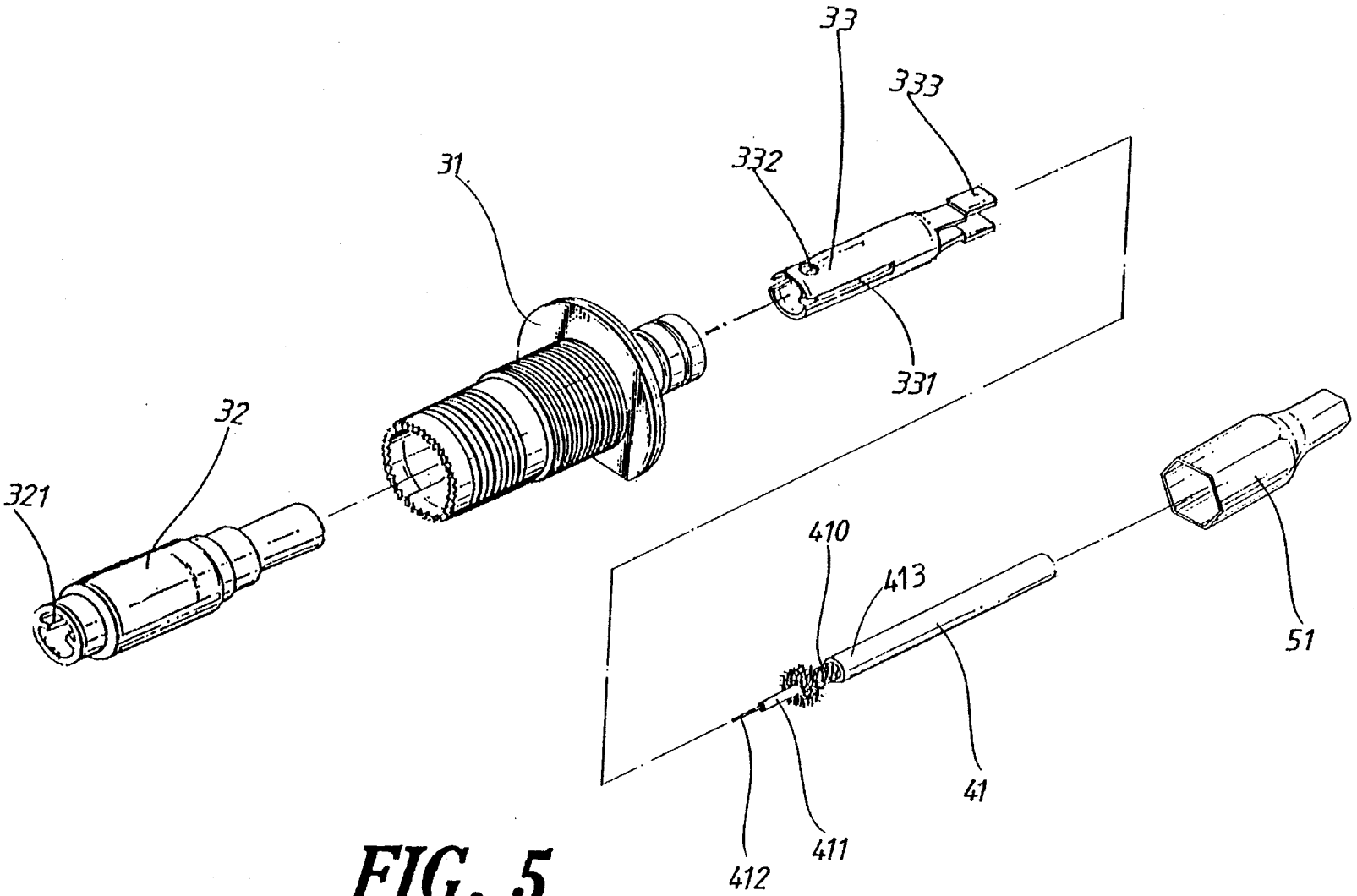
FIG. 5 is a disassembled perspective view of an embodiment of the present invention.

Please refer to FIG. 5. The present invention is a mini UHF coaxial cable connector which includes a die casting housing 31 having a first end and a second end, a dielectric 32 tightly fitted inside the die cast housing 31, a terminal 33 disposed inside the dielectric 32, a coaxial cable 41, and a ferrule 51 that surrounds and fixes a portion of the coaxial cable 41 connected to the second end of the die cast housing 31.

The terminal 33 is formed at a first end with two axially extending and substantially circumferentially opposed elongated slots 331, a radially and inwardly projecting embossed area 332 formed near the inner end of the terminal 33, and two clamping feet 333 provided at an outer end of the terminal 33 opposite to the inner end thereof.

The dielectric 32 is formed with two axially extended and substantially circumferentially opposite elongated ribs 321, radially and inwardly projecting from an inner wall of the dielectric 32 to just engage with the two long slots 331 of the terminal 33 when the terminal 33 is disposed inside the dielectric 32, such that the terminal 33 does not rotate relative to the dielectric 32.

Figure 4:
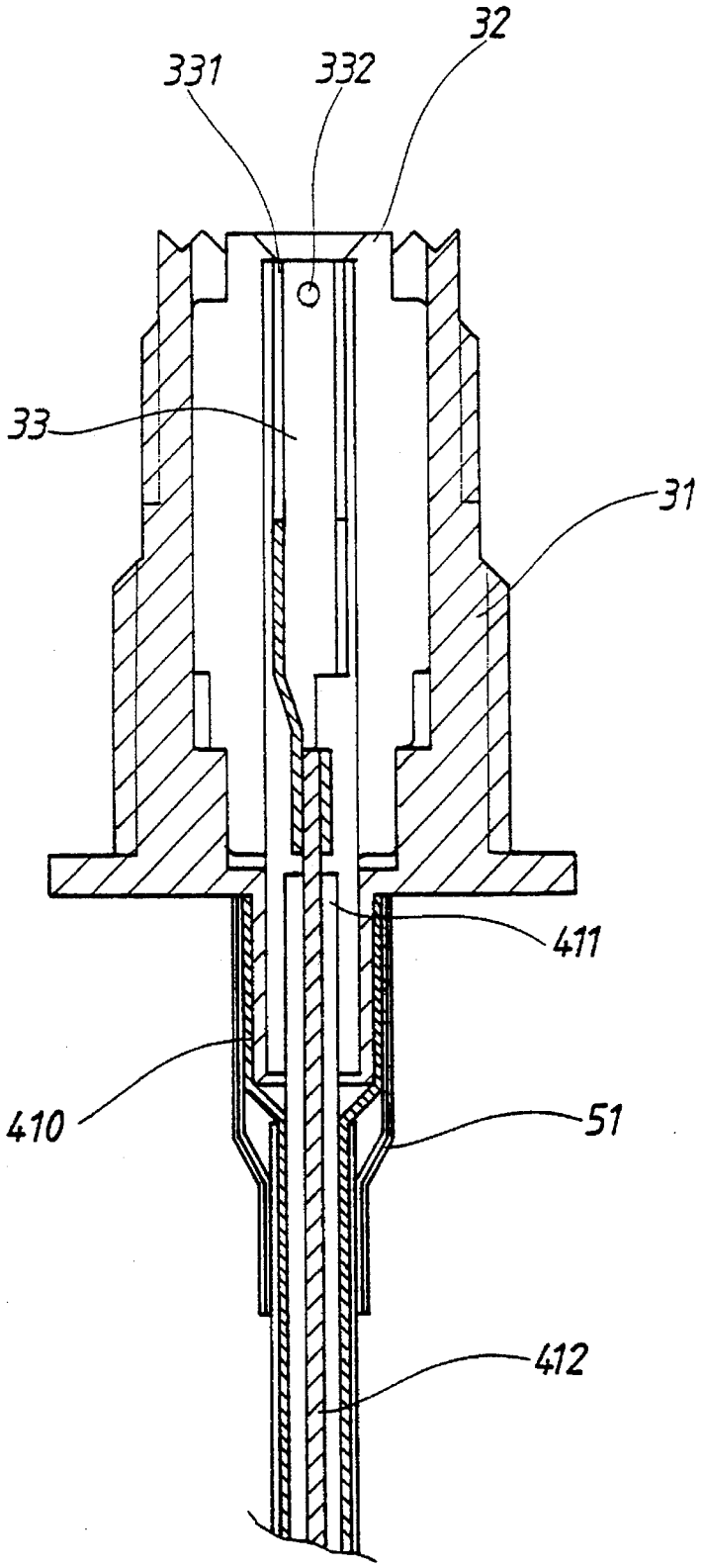
FIG. 4 is a vertical sectional view according to FIG. 3.

The coaxial cable 41 has an exposed center conductor 412 at a first end thereof, extending into the terminal 33 and being clamped therein by the two clamping feet 333. A part of a braid 410 of the coaxial cable 41 is used to wrap round the second end of the die cast housing 31, and then the ferrule 51 is used to cover and thereby tightly clamp the coaxial cable 41 at its outer insulation 413 to firmly connect the coaxial cable 41 to the second end of the die cast housing 31, as shown in FIG. 4.

Figure 1:
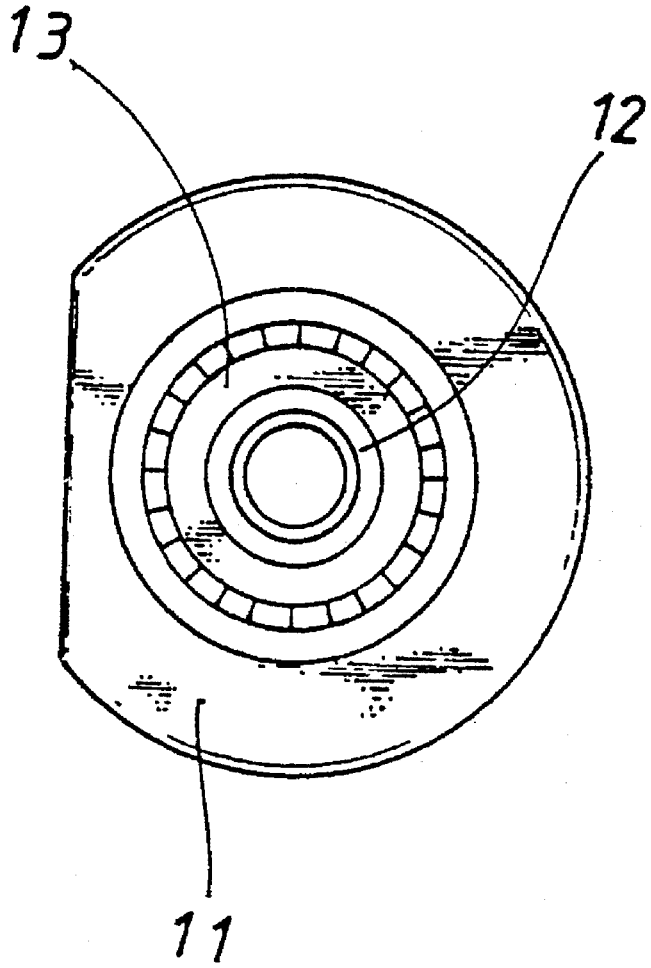
FIG. 1 (PRIOR ART)
FIG. 1 is a cross-sectional view showing the structure of a conventional antenna base connection.
Figure 2:
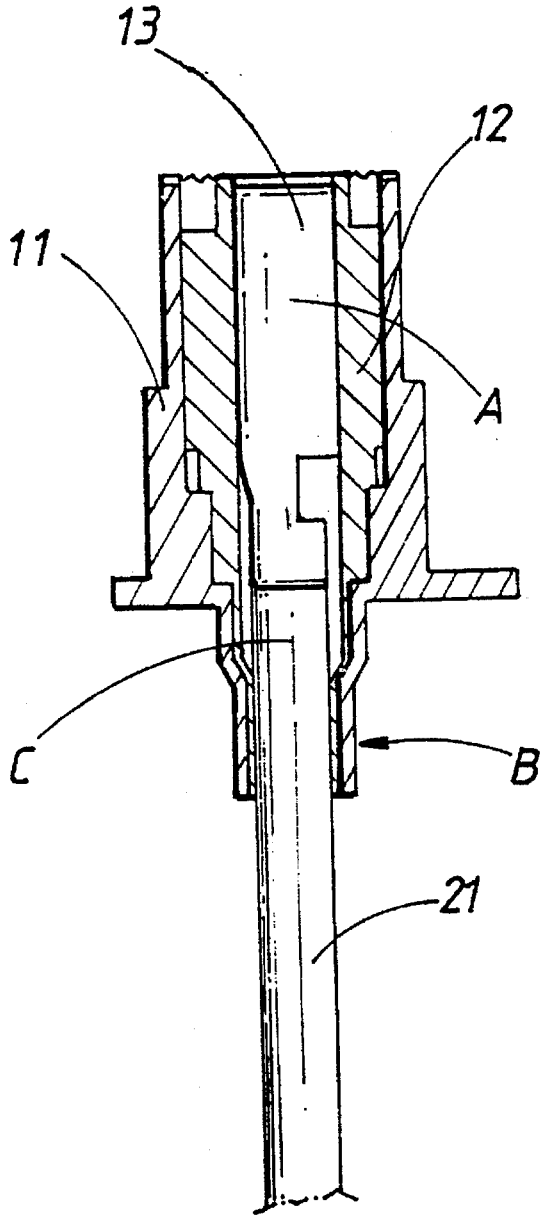
FIG. 2 (PRIOR ART)
FIG. 2 is a vertical sectional view according to FIG. 1.
Figure 3:
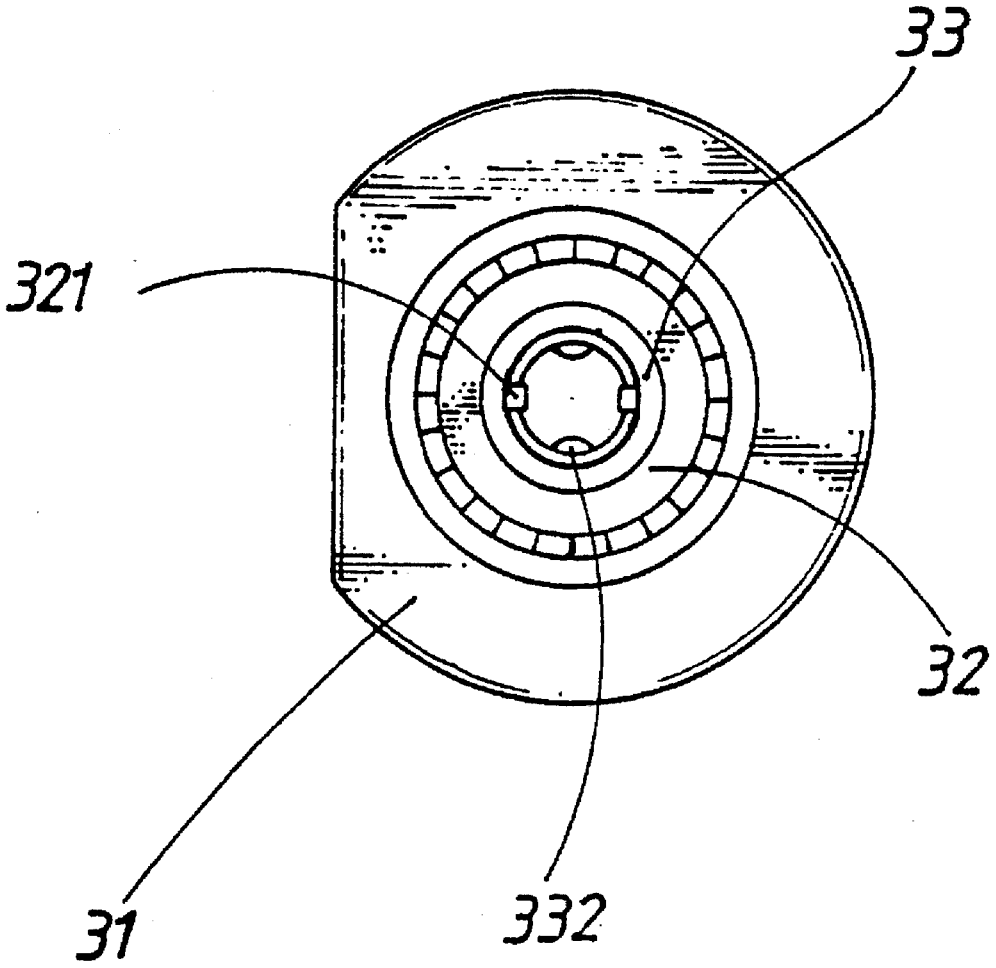
FIG. 3 is a cross-sectional view showing the structure of an embodiment of the present invention.

From FIG. 3, it can be seen that the die cast housing 31, the dielectric 32, the terminal 33, and the coaxial cable 41 of the connector according to the present invention are tightly connected to one another. The engagement of the elongated slots 331 of the terminal 33 with the elongated ribs 321 of the dielectric 32 prevents the terminal 33 from rotating relative to the dielectric 32 when the antenna is screwed into the connector and, as a result, breakage of the center conductor 412 of the coaxial cable 41 at the connecting and during screwing can be prevented. Furthermore, the embossed area 332 provided inside the terminal 33 may serve as a compressing means to provide better contact of the connecting end of the coaxial cable 41 with the terminal 33 and thereby permit a better electrical connection thereof.

With the above arrangements, the mini UHF coaxial cable connector according to the present invention provides enhanced electrical connection and avoids twisting and breakage of the center conductor of the cable and, therefore, is practical and economical in use.

What is claimed is:

1. A mini UHF coaxial cable connector comprising a die cast housing having a first end and a second end, a dielectric tightly fitted inside said die cast housing, a terminal disposed inside said dielectric, a coaxial cable including a center conductor, an inner insulation layer surrounding said center conductor, a braid layer surrounding said inner insulation layer, an outer insulation layer surrounding said braid layer, and a ferrule for fixing a portion of said coaxial cable to said second end of said die cast housing, wherein said terminal is formed at a first end with two axially extending and substantially circumferentially opposite elongated slots, and said dielectric is formed with two axially extending and substantially circumferentially opposite elongated ribs radially and inwardly projecting from an inner wall of said dielectric to engage said two elongated slots of said terminal when said terminal is disposed inside said dielectric, such that said terminal is prevented from rotating relative to said dielectric when an antenna is screwed into said die cast housing of said mini UHF coaxial cable connector.

2. A mini UHF coaxial cable connected as claimed in claim 1, wherein said terminal has a radially and inwardly projecting embossed area formed near said first end thereof to serve as a compressing means to provide better contact of said coaxial cable with said terminal and thereby permit better electrical connection therebetween.

* * * * *